United States Patent [19]

Bowler, Jr. et al.

[11] 3,940,518

[45] Feb. 24, 1976

[54] BAKE TECHNIQUE FOR MANUFACTURING TETRAFLUOROETHYLENE COATED ROLLS

[75] Inventors: Edward F. Bowler, Jr., Webster; Joseph M. Stupin, Jr., Ontario; Edward G. Williams, Macedon, all of N.Y.

[73] Assignee: Xerox Corporation, Stamford, Conn.

[22] Filed: Apr. 26, 1974

[21] Appl. No.: 464,384

[52] U.S. Cl. ..... 427/379; 118/101; 427/375; 427/385; 427/407; 428/422

[51] Int. Cl.[2] ..... B05D 1/38; B30B 3/00

[58] Field of Search ..... 117/132 CF, 75, 72, 94, 117/161 UF; 427/379, 385, 407, 375

[56] References Cited

UNITED STATES PATENTS

| | | | |
|---|---|---|---|
| 3,437,032 | 4/1969 | Manghirmalani et al. | 117/75 X |
| 3,554,955 | 1/1971 | Hartwimmer et al. | 117/132 CF X |
| 3,776,760 | 12/1973 | Baker et al. | 117/132 CF X |

*Primary Examiner*—Ralph Husack

[57] ABSTRACT

A method for preparing polymer coated rolls for use in a xerographic reproducing apparatus is given whereby coatings of tetrafluoroethylene primer and enamel are applied, dried at low temperatures and baked at temperatures below the fusion temperature followed by a final heating step to fuse the tetrafluoroethylene enamel coating.

10 Claims, No Drawings

BAKE TECHNIQUE FOR MANUFACTURING TETRAFLUOROETHYLENE COATED ROLLS

This invention relates to improvements in heat fusing devices and, more particularly, to an improved apparatus for fixing xerographic powder images.

Specifically, this invention relates to an improved heatedroll fusing device. Although the invention is considered to have general application, it is particularly useful in the field of xerography and has an important application in the fusing of resinous powder images produced by electrophotography or xerography onto sheets of paper or other substrates upon which powder images have been transferred after they have been formed by deposition of developing powder on an electrostatic latent image bearing surface. Therefore, for the convenience of illustration only, the invention will be described with reference to its use as a heat fuser for xerographic powder images. However, it is to be understood that it may be employed with equal facility in other fields.

In the process of xerography as disclosed, for example, in U.S. Pat. No. 2,297,691, a xerographic plate, comprising a layer of photoconductive insulating material on a conductive backing, is given a uniform electric charge over its surface and is then exposed to the subject matter to be reproduced, usually by conventional projection techniques. This exposure discharges the plate areas in accordance with the radiation intensity that reaches them, and thereby creates an electrostatic latent image on or in the photoconductive layer. Development of the latent image is accomplished with an electrostatically charged, finely-divided, developing material or toner which is brought into surface contact with the photoconductive layer and is held thereon electrostatically in a pattern corresponding to the electrostatic latent image. Thereafter, the developed powder image is usually transferred to a support surface, such as paper, to which it may be fixed by any suitable means.

One of the methods in common use for developing the electrostatic latent image is described in U.S. Pat. No. 2,618,551, and is known as cascade development. In this technique the powder or toner is mixed with a granular "carrier" material, and this two-component "developer" is poured or cascaded over the plate surface. The function of the carrier material is to improve the flow characteristics of the powder and to produce, on the powder, by triboelectrification, the proper electrical charge so that the powder will be attracted to the image. More exactly, the function of the carrier material is to provide the mechanical control to the powder, or to carry the powder to an image surface, and simultaneously, to provide homogeneity of polarity.

A variety of types of finely-divided electroscopic powders may be employed for developing electrostatic latent images. However, as the art has progressed, it has been found preferable to develop copy images with a powder or toner formed of any of a variety of pigmented thermoplastic resins that have been specifically developed for the purpose. A number of such developing materials are available commercially, and these developing materials are specifically compounded for producing dense images of high resolution and to have characteristics to permit convenient storage and handling. Such developing materials are compounded to permit them to be fixed to the surface of a transfer material either by heat fixing or vapor fixing techniques, in accordance with the particular application in which they are employed, that is, the individual particles of resin (toner) soften and coalesce when heated or plasticized by solvent, so that they become sticky or tackified and readily adhere to the surface of the transfer material.

The term "tackified" and the several variant forms thereof used throughout this specification are employed to define the condition of the powder particles of the electrostatic powder image when heated or plasticized by a solvent in a manner such that the individual particles soften and coalesce, and in which state they become sticky and readily adhere to other surfaces. Although this condition necessary requires a flowing together of the particles to effect a thorough fusion thereof, it is to be understood that the extent of such flowing is not sufficient to extend beyond the boundary of the pattern in which the particles are formed.

One of the important applications of the process of xerography comprises its use in automatic copying machines for general office use wherein powder images formed on a xerographic plate are transferred to paper and then fixed thereon by heat fusion. In order to fuse resinous images formed by the powdered resins now commonly used, it is necessary to heat the powder and the paper to which it is to be fused to a relatively high temperature, such as approximately 325°F. It is undesirable, however, to raise the temperature of the paper substantially higher than 375°F. because of the tendency of paper to discolor at such elevated temperatures.

The art has long recognized that one of the fastest and most positive methods of applying heat for fusing the powder image to paper is to bring the powder image into direct contact with a hot surface, such as, for example, a heated flat plate.

But as the powder image is tackified by heat, part of the image carried by the support material will stick to the surface of the heated plate so that as the next sheet is placed on the heated plate, the tackified image partially removed from the first sheet will partially transfer to the next sheet and at the same time part of the tackified image from said next sheet would adhere to the heated plate. This process is commonly referred to in the art as "set off" or "offset".

The offset of toner onto the heating surfaces led to the development of improved methods and apparatus for fusing the toner images, notably the process and apparatus described in U.S. Pat. No. 3,268,351. The toner images there are fused by forwarding the sheet or web of paper bearing said image between two heated rolls, the roll contacting the image surface provided with a thin coating of tetrafluoroethylene resin and a silicone oil film to prevent toner offset. Tetrafluoroethylene resin is sold under the trademark "Teflon" by E. I. duPont De Nemours & Co. Both tetrafluoroethylene resin and silicone oil have physical characteristics such that they are substantially abhesive to dry or tackified xerographic developing materials. "Abhesive" defines a surface that has "release" characteristics such that it is highly repellent to sticky or tacky substances.

Although the use of a tetrafluoroethylene resin-coated roll in xerographic reproducing apparatus has been a great improvement, certain problems with respect to the resin-coated rolls have developed. For example, in the ordinary process for manufacturing the resincoated rolls, it is necessary, in order to attain sufficient resin thickness on the surface of the roll, to apply multiple coatings of resin. This has often resulted in resin coatings which are not homogeneous in thickness and which on occasion have been subject to blistering. Therefore, the durability of certain resin-coated rolls has been somewhat less than one would desire.

It is therefore the principal object of this invention to improve the construction of a fluorocarbon, that is, tetrafluoroethylene resin-coated rolls to provide adherent thicknesses of resin thereon and avoid blistering.

Another object of this invention is to provide a tetrafluoroethylene resin-coated roll which will have greater durability.

Still another object of this invention is to provide the method of manufacturing the resin-coated rolls so as to achieve improved efficiency and economy.

These and other objects of this invention are attained by the means of successively applying to the roll thin coatings of tetrafluoroethylene enamel film, and between each application, permitting the coating to substantially dry before baking the filmcoated roll to a temperature not exceeding the fusion temperature of tetrafluoroethylene. When the desired thickness of coating is attained, the coated rolls are subjected to a temperature of from about 700° to 850°F., preferably 730°–750°F., in order to fuse the tetrafluoroethylene resin coating. This is in contrast to one previously employed method by which the rolls were heated to fusion temperature after each thin layer of tetrafluoroethylene enamel was applied.

There is thus provided a unique process for applying tetrafluoroethylene resin coatings to xerographic apparatus fusing devices. The resulting coating is very strong and will not blister. Another advantage derived from the practice of this invention is that the tetrafluoroethylene primer, which must be applied to the roll before application of the tetrafluoroethylene enamel, can be cured at a temperature significantly lower than has heretofore been required.

The process of this invention is a multiple step process involving: (1) application of a tetrafluoroethylene primer; (2) substantially drying the primer; (3) heating the primer-coated roll at a temperature sufficiently high to cause baking of the primer substance; (4) applying a thin coating of tetrafluoroethylene enamel liquid; (5) substantially drying the enamel liquid removing water and solvent; (6) baking the coating at a temperature below the fusion temperatures of tetrafluoroethylene; (7) repetition of steps (4), (5) and (6) until one attains the desired thickness of tetrafluoroethylene enamel on the roll; and (8) heating the coated roll to a high temperature in order to fuse the coating. In the final coating step, one may elect to omit the baking step and heat the coated roll to fusion.

Prior to applying the tetrafluoroethylene primer, it is essential that the surface of the roll be properly prepared. The surface should be clean and free of all greasy substances. Furthermore, adhesion of the primer is improved if the surface has been roughened in a uniform manner. Methods of properly preparing the surfaces, such as solvent cleaning, grit blasting, chemical etching, wheel sanding, etc. are well known to a person skilled in the art.

After the surface of the roll has been properly prepared, the tetrafluoroethylene primer is applied. A number of primer substances are available; duPont's Teflon 850–204 or 850–314 is especially suitable for application in xerographic reproducing machine fuser rolls. One coat of primer is generally applied and its thickness may be from about 0.2 mil to about 0.7 mil. The primer film, which is a liquid, may be conveniently applied by air atomization, either manually or, preferably, automatically.

The liquid primer film typically contains 30 to 50 percent water and other volatile materials. A drying step is necessary prior to curing the film. This may be done under ambient conditions. It is believed necessary to remove substantially all of the water and other volatile materials. In a preferred embodiment, the drying step can also be performed by forced air drying at between about 70°F. and 80°F. This is further advantageously done under low humidity conditions, preferably from about 10 to 60 percent relative humidity. After the drying step has been completed, the rolls are ordinarily subjected to a sintering temperature of from about 700° to 850°F. in order to fuse the tetrafluoroethylene primer. It has previously been considered very important to use these high temperatures in the application of tetrafluoroethylene enamel. However, in the process of this invention, one employs only a single-fusion step in the application of the tetrafluoroethylene enamel. Under these circumstances, the baking of the tetrafluoroethylene primer can be accomplished at a significantly lower temperature, namely at about 400°F. to about 550°F., for from about 10 to about 30 minutes. Preferably, one may bake the primer at 475°F. for about 20 minutes. The use of these lower temperatures is one advantage derived from this invention. In addition to the obvious advantage of cost savings resulting from operation at lower temperatures, there is no danger of over baking the primer coat and running the risk of poor intercoat adhesion after the enamel is applied.

The application of the tetrafluoroethylene enamel coats is performed in a manner analogous to the primer coat. For purposes of this invention, one may use one of duPont's "high build" tetrafluoroethylene enamels. These are substances which can be applied in thicknesses up to about 2.5 to 3.0 mils without running the risk of "mud cracking". Mud cracking is the phenomenon which occurs when a wet enamel film is too thick and the particles are pulled apart on drying because of shrinkage. Suitable for application in xerographic reproducing machine rolls of this invention is Teflon 851–224. Large thicknesses are not required for this invention and one may apply any thickness desired. Each individual coating thickness may be from about 0.2 to about 0.9 mil. Thicknesses of 0.2 to 0.5 mil are preferred because of the high quality fuser rolls produced.

After the application of each tetrafluoroethylene enamel coat, a roll is completely dried in a similar fashion to that used to dry the primer in order to flash off or remove the water and other volatile materials contained in the film. Again this may be done by drying under ambient or room temperature conditions or by using a controlled temperature and/or humidity as discussed above. After the drying is completed, the coated roll is baked by heating to a temperature below the fusion temperature of tetrafluoroethylene. Care should be used not to fuse the tetrafluoroethylene in this step. Baking at between about 600°F. and the fusion temperature, normally considered about 680°F., for from about 10 to about 30 minutes is usually satisfactory. Preferred results are achieved when the baking is accomplished at about 650°F. for about 20 minutes.

In many processes heretofore practiced, after each coating and drying step, the tetrafluoroethylene enamel-coated rolls were placed in an oven and heated at high temperatures (725° to 800°F.) in order to fuse the enamel coating. Under this invention, these repeated fusion steps are undesirable and should be avoided in order to achieve the unique product of this process.

It has been found that the optimum thickness of tetrafluoroethylene resin coating on rollers used for xerographic reproducing apparatus is between about 0.8 to 6 mils. Lower thicknesses are generally preferred. When the desired thickness has been achieved by successive coatings, drying, and baking, the coated roll is then subjected to a fusion temperature of from about 700°F to 850°F., preferably from about 730° to 750°F. The fusion time is about 10 to 20 minutes.

The following specific example describes the method and technique of this invention. It is intended for illustrative purposes only and should not be construed as a limitation.

Fuser rolls for xerographic reproducing apparatus which have been coated with Teflon 850-314 primer and baked at a temperature of 475°F., are mounted on a moving conveyor. They are then carried through a spray booth past a spray gun apparatus from which they receive one coat of Teflon 851-224 enamel having a dry film thickness of 0.4 mil. The rolls pass through a flash-off zone where they are subjected to warm, dry air at the temperature of 75°F. with a relative humidity of 30 percent. The volatile solvents and water in the enamel film are removed by this treatment in approximately 20 minutes. The roll is then baked at 650°F. for 20 minutes. The baked, Teflon coated roll is again presented to the spray guns. The cycle of spraying, drying, and baking is continued for two more passes until a film of about 1.2 mils is attained. The rolls are then removed immediately to a fusing oven where the temperature is maintained at about 740°F. The rolls are subjected to this metal temperature for 15 minutes. They are observed to have a durable, uniform coating.

While the present invention has been described by the specification and examples, the invention is not so limited. Many modifications can be made by one skilled in the art without departing from the spirit and scope of the invention which should be viewed through the appended claims.

What is claimed is:

1. A method for manufacturing a polymer coated roll for use in a xerographic reproducing apparatus comprising:

applying to the surface of the roll a tetrafluoroethylene primer;

drying the primer;

heating the primer-coated roll until the primer is baked;

applying to the surface of said roll a liquid coating consisting essentially of tetrafluoroethylene enamel;

drying said coating;

baking the coated roll at a temperature below the fusion temperature of tetrafluoroethylene resin;

applying at least one more additional liquid coating of tetrafluoroethylene enamel, drying, and baking of said coating after each application at a temperature below the fusion temperature of tetrafluoroethylene resin until the desired thickness of tetrafluoroethylene enamel on the surface is attained; and heating the coated roll at a temperature sufficient to cause fusion of the tetrafluoroethylene coating.

2. The method of claim 1 wherein drying is accomplished at ambient temperature.

3. The method of claim 1 wherein drying is accomplished at a temperature of from about 70°F. to about 80°F.

4. The method of claim 3 wherein drying is accomplished at between about 10 percent and about 60 percent relative humidity.

5. The method of claim 1 wherein the primer is baked at between about 400°F. and about 550°F.

6. The method of claim 1 wherein the primer is baked at about 475°F. for between about 10 and about 30 minutes.

7. The method of claim 1 wherein the tetrafluoroethylene enamel is baked at a temperature of between about 600°F. and below the fusion temperature for between about 10 and about 30 minutes.

8. The method of claim 1 wherein the tetrafluoroethylene enamel is baked at a temperature of about 650°F. for about 20 minutes.

9. The method of claim 1 wherein the tetrafluoroethylene coating is fused at a temperature of between 725°F. and 800°F.

10. The method of claim 1 wherein the tetrafluoroethylene coating is fused at a temperature of about 750°F.

* * * * *